United States Patent [19]

Wayser

[11] 4,161,829

[45] Jul. 24, 1979

[54] SHOES INTENDED FOR PLAYING GOLF

[76] Inventor: Alain Wayser, 21 rue du Bac, 75007-Paris, France

[21] Appl. No.: 914,725

[22] Filed: Jun. 12, 1978

[51] Int. Cl.[2] ..... A43B 5/00; A43B 13/04

[52] U.S. Cl. ..... 36/127; 36/32 R

[58] Field of Search ..... 36/127, 114, 32 R, 132, 36/103, 104

[56] References Cited

U.S. PATENT DOCUMENTS

| | | | |
|---|---|---|---|
| 2,518,649 | 8/1950 | Tydings et al. | 36/11.5 |
| 2,847,769 | 8/1958 | Schlesinger | 36/71 |
| 3,875,689 | 4/1975 | Tomas | 36/32 R |
| 4,030,213 | 6/1977 | Daswick | 36/103 |

*Primary Examiner*—Patrick D. Lawson

*Attorney, Agent, or Firm*—Fisher, Christen & Sabol

[57] ABSTRACT

The present invention relates to a pair of shoes for playing golf, of which the bottom extends from the sole to the heel without change in level of the heel, the body thus resting in a zone between the heel and the plantar arch, the sole comprises studs and bevelled portions disposed asymmetrically, one bevelled portion being located on the outer left edge of the sole of the left shoe and one bevelled portion also being located on the left-hand part or inner part of the front zone of the sole of the right shoe, the above disposition of the bevelled portions being intended for a right-handed player and being reversed for a left-handed player.

7 Claims, 4 Drawing Figures

SHOES INTENDED FOR PLAYING GOLF

The present invention relates to sports shoes, and more particularly golf shoes.

Numerous types and designs of shoes exist which are intended to be adapted more or less well to the conditions of use; in particular, aesthetics are sought for in town shoes, comfort in indoor shoes, a good foot support in walking whoes, lightness for sports such as running or sports involving rapid movements (tennis, basket-ball, ...).

However, these shoes are always constructed along the same general lines and their characteristic results less from a specific design or construction than from the use of the raw materials used (leather, fabric, rubber).

The present invention relates to a pair of shoes comprising characteristics of original structure which are particularly adapted to the practice of a specific sport : golf.

Playing golf involves physical movements which are specific of this sport, when the player strikes the ball; on the other hand, playing golf also involves walking movements, which are considerable as the player convers a minimum of about ten kilometers for an average game.

It follows that the golf shoe must comply with divergent imperatives : on the one hand it must be a good walking shoe to allow the player to cover the course comfortably and practically; however, when striking the ball, the player must find in the pair of shoes which he is wearing a support surface which is both stable and at the same time flexible and able to follow, without counteracting them, the displacements of the stretched body making the rapid, even violent movement which must project the ball at the desired distance and angle. Now, it is known that in this movement, the player must start from a position in which the spine is straight, the weight of the body resting in a zone between the heel and the plantar arch then the body moves under the effect of the centrifugal force accumulated at the end of the club when the ball is struck; in this displacement, the body, whilst remaining on the same points of support, makes a slight movement on the two legs to initiate a displacement in the direction of departure of the ball; in this way the left knee (in the case of a movement executed by a right-handed person) moves slightly outwardly, the left foot thus being angularly pivoted, bearing on the outside of the sole; the right knee moves towards the left knee so as to displace the weight of the right leg toward the left; the heel rises from the ground whilst the foot bears on the left-hand front tip of the sole.

The shoe produced according to the invention comprises original structural characteristics which enable them to assist and facilitate the position and movements of the player in the different phases of playing golf, from the walking phase to the movements of striking the ball.

To this end, the invention relates to a pair of golf shoes, wherein each of the shoes of said pair comprises a bottom extending from one end to the other, substantially on the same plane, forming a sole and a heel, without change in level of the heel with respect to the sole, the bottom comprising a thickness slightly smaller at the level of the heel with respect to the sole, this bottom further comprising projections, such as metal studs, the inner part of the shoe comprising a convex portion for supporting the plantar arch, the sole comprising further over limited portions of the edges of said sole, recesses forming bevels, preferably curved, allowing the movement of pivoting of the shoe with respect to the ground.

The invention will be more readily understood on reading the following description with reference to the accompanying drawings, in which.

Figure 1:
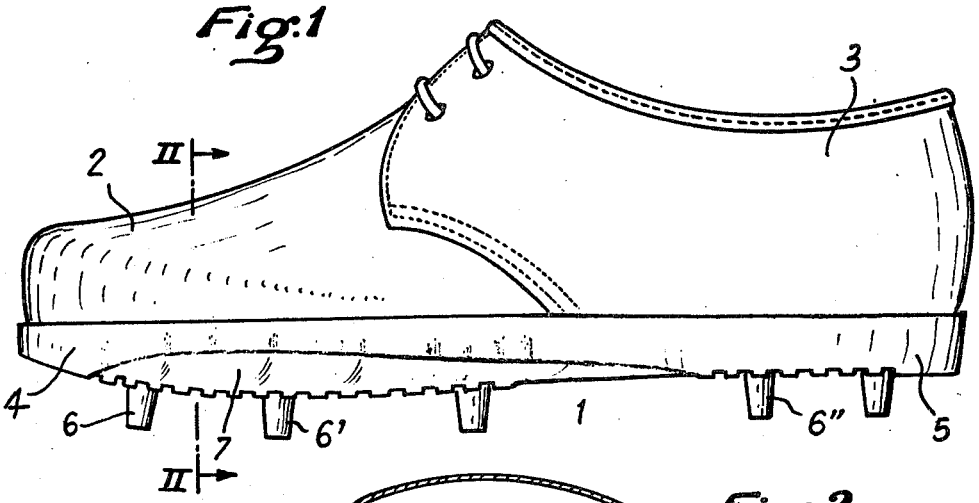
FIG. 1 is a view in side elevation of the left shoe of a pair of shoes according to the invention.
Figure 2:
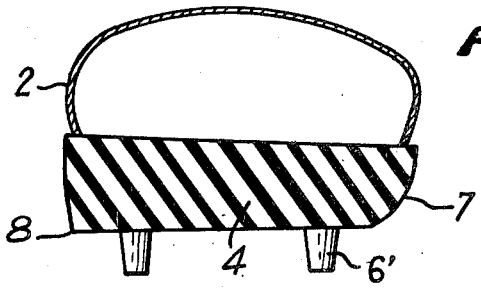
FIG. 2 is a view in section along II—II of FIG. 1.

Referring now to the drawings, FIGS. 1 and 2 show a left shoe of a pair of golf shoes according to the present invention.

FIG. 1 shows a side elevation thereof.

This shoe comprises a support surface which is constituted by a moulded sole 1 on which are mounted the vamp 2 and the upper 3.

Of course, the sole could be made from a plurality of layers of leather which are joined together and sewn.

In the present case, the bottom comprises a front part 4 constituting the sole and a rear part forming the heel 5.

The heel does not, however, comprise any change in level with respect to the sole 4; on the contrary, the thickness of the heel 5 is preferably slightly smaller than that of the sole 4 so that the weight of the body rests in a zone between the heel and the plantar arch. Experience has shown that this shape ensures a straight position for the spine, the body facing the ball.

This shape therefore makes it possible to obtain a correct position of the player when he prepares to strike the ball at his feet, the weight of the body then resting substantially on the two heels. The studs 6,6', 6" have for their purpose to allow, apart from a greater comfort in walking, a firm support of the body of the ground, avoiding the displacements or pivotings of the feet along the support plane constituted by the ground under the effect of the force put forth by the player in the movement of striking the ball.

According to the invention, the left shoe shown in FIGS. 1 and 2 comprises a slightly curved bevel 7 on the lower part of the outer edge of the sole, i.e. on the lower angle of the edge on the left-hand side of the sole.

This bevelled side face 7 enables the left shoe to pivot outwardly, the contact of the shoe and foot on the ground being made by this curved bevelled face 7.

The invention thus eliminates the edge which would be homologous to edge 8 (FIG. 2) on the opposite side and which is replaced by a curved face 7; this face 7 resting on the ground enables the pivoting movement of the foot to the outside to be regularly guided.

Figure 3:
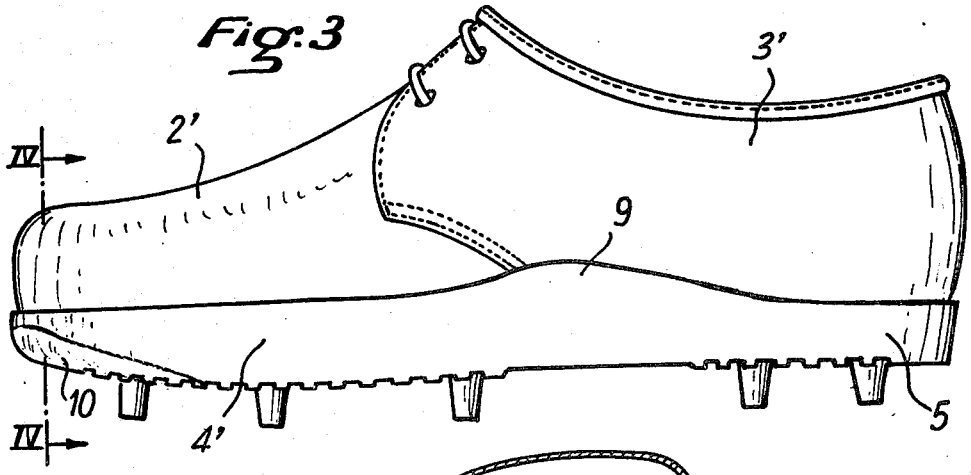
FIG. 3 is a view in elevation of the right shoe of the pair according to the invention, this view being seen from the left side of said shoe.
Figure 4:
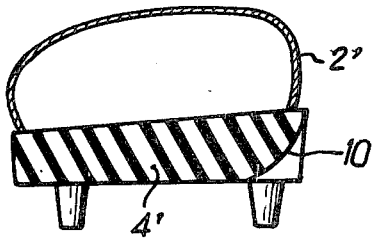
FIG. 4 is a view along IV—IV of FIG. 3.

FIGS. 3 and 4 show a view of the right shoe of a pair of golf shoes according to the invention.

The right shoe shown in FIG. 3 is seen from the inside, i.e. by its left face.

The shoe is seen to comprise an arch support 9 at the level of the plantar arch (in manner known per se).

The right shoe comprises on the front left-hand part of its sole a curved bevel 10 seen in section in FIG. 4 which allows the translation of the right foot when the legs bend slightly to be adapted to the movement of the body when the club strikes the ball; the right foot is then pivoted inwardly, the sole partly leaving the ground;

the shoe rests on the front left-hand part of the sole; the rounded portion 10 thus enables the shoe to follow this movement and to guide it more surely, contact being established via a surface and not via the edge which would normally be constituted by the lower edge of the sole.

The features which have been described hereinabove concern essentially a pair of golf shoes intended for a right-handed person.

It will be readily appreciated that the movements are reversed for a left-handed player, the features of the shoe therefore likewise being reversed as far as the location of the bevelled portions is concerned; in this case, it is the lower half of the outer edge, i.e. the right side of the sole of the right shoe which would comprise the bevelled portion 7; whilst it is the inner portion, i.e. the right half of the left shoe which which would comprise the curved bevelled portion 10 at the front of the sole.

The invention therefore enables a pair of shoes to be worn which are particularly adapted for playing golf whilst facilitating walking when moving over the course; it ensures a correct position of the body resting straight in a zone between the heel and the plantar arch when the player is preparing to strike the ball, and finally the shoes are adapted to the displacements of the feet and legs which, without leaving their support surface and whilst giving the player a perfect stability on the ground, allow the body to be adapted to the particularly violent movements of the arms and the club striking the ball.

A pair of shoes is thus produced which gives the player a greater mastery over his movements and an increased effeciency on striking the ball.

It will be specified that the shoes made according to the invention will be of much greater usefulness for learners and inexperienced players than for professionals or experienced amateurs; in fact, the latter have acquired the reflexes enabling them to have the correct position facing the ball at the moment of striking; on the other hand, these reflexes are not yet acquired by the learner and he must practice many years before attaining the desired result of acquiring the reflexes of correct positioning (spine straight and weight resting on a zone between the heel and the plantar arch) facing the ball.

The pair of shoes produced according to the invention enables the novice automatically to acquire the correct positioning right from the beginning; in fact, the heel being slightly lower than the sole, the body normally and spontaneously takes the corresponding natural position, the spine then being straight or very substantially straight; the phenomenon of raising of the heels which tends to project the body forwards, and which must be corrected by a compensatory reverse movement, no longer occurs.

The studs ensure a firm and stable support surface for the feet during walking movement, avoiding a horizontal pivoting, whilst the bevels of the edges which have been described guide the angular pivoting movements of the foot, ensuring for the foot (when it is inclined) a surface-on-surface contact and not a line-on-surface contact (along the angle formed by the edge of the sole and the sole itself).

What I claim is:

1. A pair of golf shoes, wherein each of the shoes of said pair comprises a bottom extending from one end to the other, substantially on the same plane, forming a sole and a heel, without change in level of the heel with respect to the sole, the bottom comprising a thickness slightly smaller at the level of the heel with respect to the sole, the bottom comprising a thickness slightly smaller at the level of the heel with respect to the sole, this bottom further comprising projections, such as metal studs, the inner part of the shoe comprising a convex portion for supporting the plantar arch, the sole comprising further over limited portions of the edges of said sole, recesses forming bevels, preferably curved, allowing the movement of pivoting of the shoe with respect to the ground.

2. A pair of shoes as claimed in claim 1, wherein the outer edge of the sole of the left shoe (for a right-handed person) comprises a rounded bevelled portion, facilitating the outward pivoting of the shoe by following the rounded and bevelled edge of said sole.

3. A pair of shoes as claimed in claim 1, wherein the inner half of the front end of the sole of the right shoe (for a right-handed person) comprises a slightly curved bevel facilitating the inward pivoting movement of the right foot on its tip.

4. A pair of shoes as claimed in claim 1, wherein the two shoes of each pair comprise curved bevelled zones joining on the one hand the flat nose of the sole and on the other hand the vertical edge of said sole, these bevelled zones being disposed asymmetrically on the two shoes, such a bevelled edge being disposed (for a pair of shoes intended for a right-handed person) on the outer left edge of the left foot and on the inner half or left half of the front of the sole of the right foot.

5. A pair of shoes as claimed in claim 1, intended for a left-handed person, wherein it comprises a bevelled zone joining on the one hand the flat nose of the sole and on the other hand the vertical edge of said sole and disposed on the outer edge, i.e. the right hand edge of the right shoe and on the inner part or right hand part of the front of the sole of the left shoe.

6. A pair of shoes as claimed in claim 1, wherein the outer edge of the sole of the right shoe (for a left-handed person) comprises a rounded bevelled portion, facilitating the outward pivoting of the shoe by following the rounded and bevelled edge of said sole.

7. A pair of shoes as claimed in claim 1, wherein the inner half of the front end of the sole of the left shoe (for a left-handed person) comprises a slightly curved bevel facilitating the inward pivoting movement of the left foot on its tip.

* * * * *